United States Patent [19]

Delmer et al.

[11] Patent Number: 4,923,381

[45] Date of Patent: May 8, 1990

[54] PRESS TOOLING TRANSFER SYSTEM

[75] Inventors: Philip T. Delmer, Carlsbad, Calif.; Lewis D. Hunt, Milwaukee, Wis.

[73] Assignee: Elwood Hydraulics Co., Inc., Oak Creek, Wis.

[21] Appl. No.: 316,175

[22] Filed: Feb. 27, 1989

[51] Int. Cl.[5] ..... B30B 15/04

[52] U.S. Cl. ..... 425/77; 72/455; 425/185; 425/186; 425/193; 425/DIG. 26

[58] Field of Search ..... 425/62, 77, 185, 186, 425/193, 406, 407, DIG. 26; 72/455, 456; 100/100

[56] References Cited

U.S. PATENT DOCUMENTS

| | | | |
|---|---|---|---|
| Re. 10,866 | 9/1887 | Lister | 425/77 X |
| 2,372,021 | 3/1945 | Seiden | 72/455 |
| 4,090,391 | 5/1978 | Hish | 72/455 X |
| 4,155,476 | 5/1979 | Lipiec et al. | 425/77 X |
| 4,240,342 | 12/1980 | Delmer | 425/77 X |
| 4,309,893 | 1/1982 | Mueller | 72/455 |
| 4,325,298 | 4/1982 | Delmer | 425/77 X |
| 4,648,825 | 3/1987 | Heil et al. | 425/186 |

FOREIGN PATENT DOCUMENTS

| | | | |
|---|---|---|---|
| 57-62900 | 4/1982 | Japan | 425/193 |

*Primary Examiner*—Richard L. Chiesa
*Attorney, Agent, or Firm*—Arthur J. Hansmann

[57] ABSTRACT

A press tooling transfer system which includes a track system having a turntable for directing a carriage, with the tool set, between several stations and a press. There is overhead service and power supply connected with the carriages for reaching to all station positions of the carriage, and there is no requirement for any power drive or the like below the level of the tracks supporting the carriages. Also, the system is in duplicative form with respect to its carriages, tracks, presses, and overhead supply, but the system can utilize a common or single knock-out station for the duplicative portions of the system, as mentioned.

12 Claims, 1 Drawing Sheet

PRESS TOOLING TRANSFER SYSTEM

The present invention is related to transport to convey tool sets or other assemblies to variously located work stations and is particularly related to systems that must operate in difficult or dangerous environments.

BACKGROUND OF THE INVENTION

A difficult environment typical to this application is the transport of tool sets into a high pressure hydraulic compaction press whose hydraulic systems apply hydraulic pressures in excess of 5,000 psi to the main piston of the hydraulic press. These pressures can generate 1,000 to 10,000 tons of force on the tooling anvils of the tool set and result in a high ratio of force on the product contained in the belt portion of the tool set. In one instance the pressed products are industrial diamonds. See U.S. Pat. No. 4,309,893. Actual force on the product may vary from 750,000 to 1,000,000 psi. Occasionally during a pressing cycle the anvils or some other part of the tooling will fail while the press is operating at full tonnage. Such failure will allow collapse of the anvils resulting in decompression of the press main cylinder and causing sudden release of the stored energy within the press structure. Therefore, damaged parts of the tooling may act like missiles endangering life and property. Consequently, the press structure or die space must be enclosed. Therefore, the transport system must be designed so as to deliver the tool set into the press through sliding access doors which will open to receive the tooling and close when the tooling is in place.

There are other considerations of environment and the process required to produce industrial diamonds that affect the design and operation of the tool transport system. To effect a seal in the high pressure chamber of the tooling pyrolitic material is used. This material and the end product, such as diamonds, is highly abrasive. These materials will cause severe wear to any moving parts and interfere with electrical relays, contacts, seals, hose connections and like parts.

The diamond process requires a recipe of carbon and suitable catalysts subjected to pressure and heat for controlled periods of time. In the diamond synthesis process, an inductive electrical current is passed via bus bar conductor through the upper anvil into the recipe and out through the lower anvil creating a circuit and heating the carbon recipe contained in the belt. A combination of heat 1,500 to 1,700 degrees, approximately 800,000 psi, and time cause a transformation of carbon into diamonds. Due to radiation and conduction of heat, the belt portion of the tooling rises above room temperature requiring the use of cooling water to control belt temperature.

Other operation requirements of the tool transport system is an ability to handle two tool sets for each press, provide a recipe load station, provide a knock-out station to remove the finished product, and, in some cases, an idle station. Two tool sets are used so that while one set is in the press, the second tool set is being prepared for the next production cycle. There are two transport system concepts that can be employed to handle two sets of tool sets. One concept uses two individual transport systems, each of which delivers a tool set to a different side of the press die space. The second concept delivers each tool set to the same side of the press die space. This second concept is feasible if a turntable unit is used along with an optional idle station It is the second concept, a turntable concept which is the subject of this invention, and, for the purpose of description in this application, this concept will be referred to as a single opening system, or alternatively, as a turntable system. There are a number of advantages in a single opening concept. Only one transport system is required to insert two tool sets. Another advantage is that one knock-out press can jointly serve two presses and four tool sets, whereas a dual opening system generally requires one knock-out system per press.

As has been previously described, the transport system include a method of inserting two tool sets into a single press opening and provide a number of external stations to perform other functions. For the purpose of this application, the preferred embodiment consists of two carriages, one for each tool set, a turntable and two or more external stations. The turntable, press stations, and external stations all have a pair of parallel rails upon which the carriages can traverse to deposit or carry the tool sets to each station.

Various methods have been used to rotate the turntable to each station and drive the carriages linearly along the tracks to each station.

One rotational method to index the turntable is a hydraulically driven pinion and ring gear, which one skilled in the art will comprehend. Two of the most frequently used carriage linear drives used have been cylinder push-pull and rack-and-pinion. All of the foregoing indexing and linear drives have experienced numerous problems due to excessive wear or malfunction of moving parts, seals, etc., because of the abrasive environment described above Accurate rotational indexing has been difficult and unreliable due to heavy outboard rotating mass and breakdown of position-indicating limit switches. The problems have been further exacerbated by the necessity of supplying hydraulic, electrical and water services to the travelling carriages. These service lines, limit switches, joints, seals, contacts, and connections have worn prematurely due to the dirty environment and the abrasive nature of the product.

It is therefore a paramount objective of the present invention to provide a turntable system that permits transport and delivers two tool sets to a single opening face of a press while providing a multiple of external work stations.

Another but equally important objective is to provide methods to rotate the turntable, index the turntable accurately and drive the carriages linearly with systems that avoid the hazards of the abrasive environment by reason of their design concept and the location of drives and services. Still another but equally important objective is to provide services electrical, hydraulic, and air to the drive system, rotational and linear, that does not require rotating joints, does not interfere with rotation of the turntable and whose source of supply is above the abrasive dirt environment. Yet another but equally important objective is a carriage linear drive system requiring no external drive mechanism cylinder, rack-and-pinion, or other means of locomotion.

SUMMARY OF THE INVENTION

In accordance with this invention, the transport system consists of a turntable, two tool-set transport carriages, a press station, and three or more external work stations.

Rotation of the turntable to a pre-programmed index is accomplished by a double-acting hydraulic cylinder. Two carriages and tool sets have discretionary position relationships during two-cycle sequence of the press. Only one of the two tool sets is programmed to position itself at an idle station. Extension or retraction of the turntable rotation cylinder will index the turntable to a work station, allowing the carriages to be linearly moved in the proper sequence to one of four positions of press station, knock-out station, recipe-load station, or idle station. With the rotation cylinder having only two positions, "in" or "out" positions, the turntable indexing is repeatable and accurate.

Air service for the carriage drive system, and water for the tool set cooling requirements are delivered to the carriages via hose suspended from an external overhead stationary support. A service stanchion, gimbled in two directions, one to accommodate rotation of the turntable and one to extend or retract hoses as the carriages move to and fro, is mounted on a fixed vertical support well above the transport turntable.

The two carriages in this embodiment are each connected and serviced by their own air and water hoses originating from the service stanchion. The carriages are equipped with two pairs of wheels, one set fore one set aft, and the carriages travel linearly on a pair of rails. Rails spaced at the same centerline as the wheel pairs are mounted on the turntable and are also mounted equally spaced at each station. The aft set of wheels is equipped with an air motor drive to provide linear locomotion to carriages. The water service connected to each carriage via hose line from the service stanchion places a cooling water source immediately adjacent to the tool set belt. When this water source is connected between the carriage and the belt, cooling water is available during the diamond making cycle or at any of the four stations and at any time during the total cycle.

When all these ideas are employed and combined together, they provide a novel solution to transport systems where the power service requirements are completely independent of the transport system. All the components previously subjected to high wear and reduced life have either been eliminated or removed from the most hazardous area, the area below the carriages.

One of the most obvious benefits is improved production time. This benefit is substantial because the process of manufacturing industrial diamonds is capital intensive, each press system being valued over $1,000,000.

Another advantage is the simplicity of the single side transport system.

Still another advantage is the combination of the turntable system, employing only a 90 degree index but permitting the use of two carriages without hose entanglement when combined with one idle station.

Other advantages of the present invention will also be apparent to those skilled in the art in the light of the following description and appended drawings.

DETAILED DESCRIPTION OF THE PREFERRED EMBODIMENT

Figure 2:
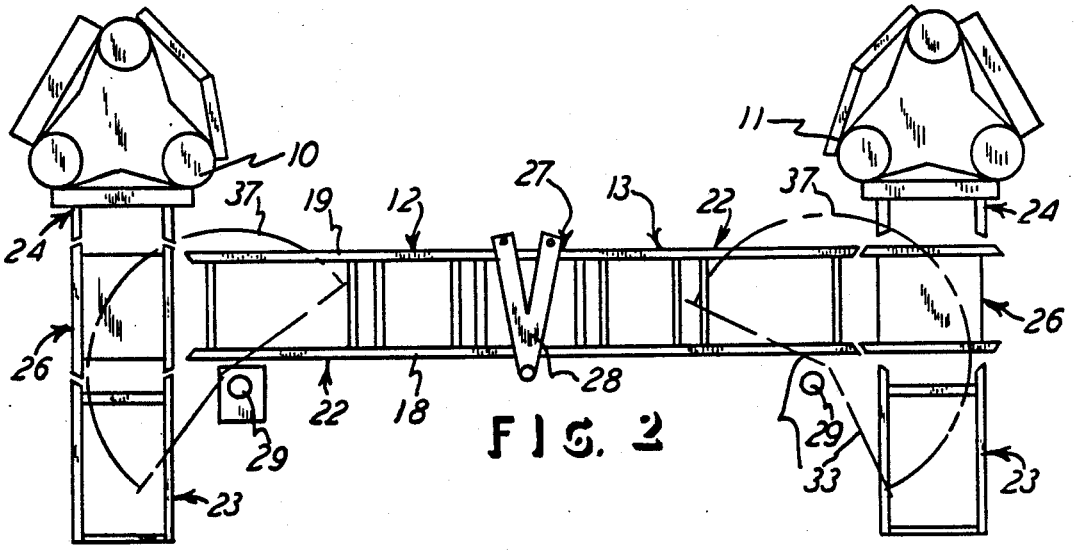
FIG. 2 is an end elevational view thereof.

This invention pertains to the press tooling transfer system which moves the press tooling from station to station for the performance upon, and storage of, the press tooling. This is tooling which is commonly used in the formation of synthetic diamonds, all as described in the introduction hereof, and, as such, one skilled in the art will be readily informed as to what the system is.

The drawings show the system in a duplicate form, that is, where two diamond presses are shown and employed, and one skilled in the art will readily understand that there could be only one press, or even more than two presses, and the system would still pertain. Nevertheless, the system is described with reference to the accompanying drawings which are shown in a manner wherein one skilled in the art will understand the system, and the drawings show the system with two diamond presses in that embodiment.

Accordingly, diamond presses 10 and 11, of conventional design such as described in the introduction hereof, are disposed as shown, and two sets of tracks 12 and 13 are shown to extend from various locations and up to the respective presses 10 and 11. The tracks 12 and 13 respectively support tool set carriages which are shown to respectively service the presses 10 and 11. That is, track 12 supports carriages 8 and 9; track 13 has carriages 14 and 16, the carriages as shown support the tool sets which are unshown, but which will be readily known to anyone skilled in the diamond press art, and it is the purpose of mobily supporting the carriages as shown, with their tool sets and recipes thereon, for movement among the various stations and two of the respective presses 10 and 11 for final processing of the recipes into the synthetic diamond desired.

Figure 1:
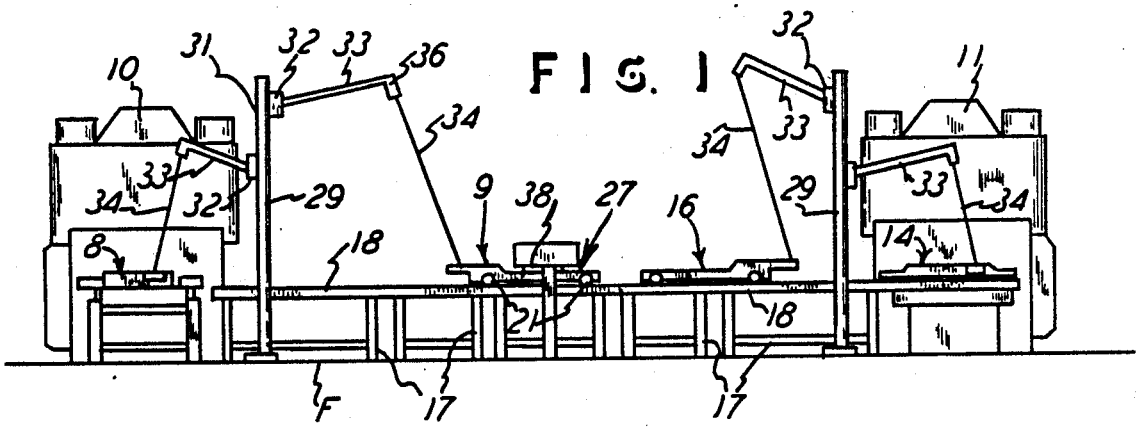
FIG. 1 is a side elevational view of a press tooling transfer system of this invention.
Figure 3:
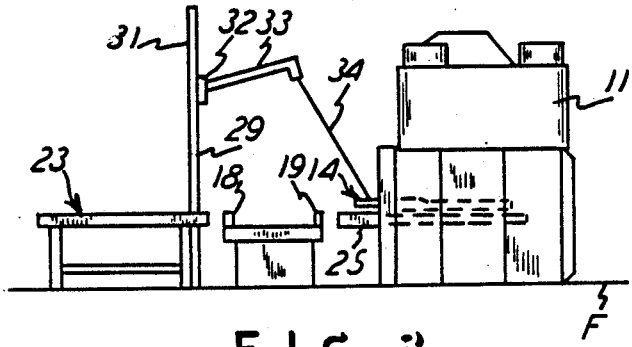
FIG. 3 is a top plan view thereof.

FIG. 1 shows a floor line designated F, and stands or supports 17 thereon, for elevated and horizontal support of spaced-apart rails 18 and 19 which form the tracks 12 and 13. It is of course these rails 18 and 19 on which the carriages as shown are mobily supported, such as by means of the carriage wheels 21. It will be further understood by anyone skilled in the art that at least some of the wheels 21 are powered, such as by an electric motor, for mobility of the carriages as shown along the tracks 12 and 13. With particular reference to FIG. 2, each track 12 and 13 includes a recipe station 22 and an idle station 23, and a press station 24, and they share a common or single knock-out station 27. Thus, each track 12 and 13 has several stations for different positioning of the respective carriages as shown, and various operations are performed at those stations, except of course for the idle station 23 which is simply a side-track station which is basically where the carriage can wait for movement say into the respective press 10 or 11. In the conventional arrangement, in the recipe station 22, the tool set is prepared with its ingredients for diamond manufacture, and the carriage can then ultimately be moved into the respective press 10 and 11 for diamond formation. To accomplish the movement of the carriages among the several stations in each branch 12 and 13, as described, each branch of track has a turntable 26 which is movable through a 90 degree arc in a conventional manner, such as by a fluid cylinder 25, as shown in FIG. 3. It will be understood that with the turntable 26 in the position shown on the right in FIG. 2, its carriage 16 can move from the recipe station 22 and onto the turntable 26. Upon rotating the turntable 26 to the position shown on the left in FIG. 2, that particular carriage as shown can then be positioned either into its respective press or its respective idle station 23. Likewise, after the carriage has been utilized in the press formation in a press 10 or 11, the turntable 26 would be in the position shown on the left in FIG. 2 so that the carriage could be withdrawn from the press, and, upon rotating the turntable to the position on the right in FIG. 2, the carriage could then be moved through the recipe station 22 and through the knock-out station 27 where the diamond material and the like is removed from the carriage. It is of course in that knock-out and removal process that there is debris fallout, and there is no powered equipment in that area below the elevation of the track to be subject to the debris or fallout and thereby be contaminated. Of course the knock-out station 27 has knock-out means 28, of a conventional arrangement for removing the diamond or the tool set, as well understood by one skilled in the art.

In order to utilize the single knock-out station 27, and thereby lower the risk of contamination at that point and also provide for efficiency and low-cost arrangement even in this expensive equipment, the two left and right-hand sections, as viewed and described herein, commonly utilize the single and common knock-out station 27. Further, there is an overhead supply of the power and like connections to the respective carriages as shown so that there is no powered equipment or the like underneath the elevation of the tracks 12 and 13, at least at the knock-out station 27. To accomplish this, each section of the system has an upstanding support, or stanchion 29 which rests on the floor F and extends to an elevation well above the elevation of the tracks 12 and 13. The upper ends 31 of each stanchion 29 has 2 swivel connections 32 each of which supports a swivel arm 33 which in turn supports a power and hose line combination designated 34. Thus each line 34 can be an electric power and coolant line which connects between the extended end 36 of the arm 33 and each of the four carriages 8, 9, 14, and 16, as shown in FIGS. 1 and 3. FIG. 3 further shows that the connector 32 for the arm 33 and the line 34 can be movable relative to the upright axes of the stanchions 29 to thus facilitate the reaching of the respective arm 33 and its line 34 to each of all of the several stations where the four carriages travel.

Of course in FIG. 1 the carriage 16 is shown supported at the recipe station 22 while the carriage 14 is shown supported in the press 11. Also, the carriage 9 is shown supported at the knockout station 27 while the carriage 8 is in the press 10. In all instances, including the instance of the carriages being at the respective idle stations 23, the cable or line 34 will reach those stations. This ability to reach is shown by the dot-dash arc designated 37 where it is also indicated that the arm 33 is swingable between the two positions designated therefor.

It will also be understood by one skilled in the art that the tool set 38 is supported in the carriage and is accessible to the power and coolant supply through the respective line connection 34. That is, the four carriages are powered for moving along the tracks 18 and 19, and the line 34 supplies that power, such as electricity. Also, when the carriages with their tool sets 38 are in their respective presses 10 and 11, there is the need for the coolant, as previously described, and again the line 34 supplies the coolant to the tool set, through the line 34 and its flow communication in the four carriages.

So, the system is duplicated in components, except for the single and commonly shared knock-out station 27. Also, the presses 10 and 11 are both of the single opening for reception of the respective carriages, and the track system described, with the turntable, accommodates the single opening in the efficient use of the expensive presses.

The invention is in the system, and anyone skilled in the art will understand the various components which comprise the system in the combination of the components. Accordingly, the drawings and description inform one skilled in the art.

What is claimed is:

1. A press tooling transport system for a high pressure press, comprising a press, two carriages for respectively carrying a tool set, several spaced-apart stations exterior of said press, a track for mobily supporting said carriages therealong, said track being disposed to interconnect said several stations in relation to one another and with said press and being arranged to accommodate supportive movement of said carriages whereby one of said carriages can move to all but one of said stations while the other of said carriages is immobile at said one station, said one of said stations being an idle station positioned for temporarily storing said other of said carriages while no work is performed at said idle station, and with said idle station being located sidetracked from all other said stations to thereby provide for cleared movement of said one of said carriages between all other said stations.

2. The press tooling transport system for a high pressure press, as claimed in claim 1, wherein said stations include a tool set knock-out station, and wherein all of the subject matter is duplicated except for said knock-out station which is common to all the remaining subject matter of claim 1 and to the duplicated subject matter, to thereby provide a single knock-out station for servicing both of the presses.

3. The press tooling transport system for a high pressure press, as claimed in claim 2, wherein said track includes two turntable portions for respective mobily supporting each two of said carriages and selectively guiding said carriages to the respective said stations and to the respective said presses.

4. The press tooling transport system for a high pressure press, as claimed in claim 1, wherein all of the subject matter is duplicated, and wherein said track includes two turntable portions for respectively mobily supporting each two of said carriages and selectively guiding said carriages to the said respective stations and to the respective said presses.

5. A press tooling transport system for a high pressure press of a type which produces a fallout of debris, comprising a press, a tool set, a carriage for mobily supporting said tool set, a track for mobily supporting said carriage and having several stations therealong for the positioning of said carriage on said track and with said track being in carriage-movement communication with said press for placing said carriage into said press, said carriage being a powered carriage and said press requiring a coolant during its operation, and overhead power and coolant distribution means connected to said carriage and being extendable to all said stations for distribution of power for mobilizing said carriage along said track and for distribution of coolant to said press when said carriage is placed into said press.

6. The press tooling transport system for a high pressure press, as claimed in claim 5, wherein said distribution means includes an upstanding stanchion means disposed adjacent said track and extending upwardly to a level higher than said carriage, and said distribution means includes both power and coolant lines connected between said stanchion means upper end and said carriage for the delivery of power and coolant to said carriage.

7. The press tooling transport system for a high pressure press, as claimed in claim 6, and including two of said carriages, and wherein one of said stations is an idle station positioned for temporarily storing one of said carriages while no work is performed at said idle station, and with said idle station being located side-tracked from all other said stations to thereby provide for cleared movement of said carriage between all other said stations.

8. The press tooling transport system for a high pressure press, as claimed in claim 5, wherein said stations include a tool set knock-out station, and wherein all of the subject matter is duplicated beyond that as claimed, except for said knock-out station which is common to all the remaining subject matter of claim 5 and to the duplicated subject matter, to thereby provide a single knock-out station for servicing both of the presses.

9. The press tooling transport system for a high pressure press, as claimed in claim 5, wherein said track includes a turntable portion and an idle station adjacent said turntable, said idle station being arranged to receive and mobily support said carriage side-tracked from the remainder of said track and while no work is performed at said tool set.

10. The press tooling transport system for a high pressure press, as claimed in claim 9, wherein said track includes a turntable portion which is alternatively rotatable through only ninety degrees of rotation in opposite directions of rotation.

11. The press tooling transport system for a high pressure press as claimed in claim 10, wherein said track includes a turntable portion which is alternatively rotatable only in opposite directions of rotation.

12. The press tooling transport system for a high pressure press, as claimed in claim 5, wherein said track includes a turntable portion which is alternatively rotatable through only ninety degrees of rotation in opposite directions of rotation.

* * * * *